US011500313B2

(12) United States Patent
Horie

(10) Patent No.: US 11,500,313 B2
(45) Date of Patent: Nov. 15, 2022

(54) IMAGING SYSTEM INCLUDING HEATING ELEMENT AND COOLING DEVICE

(71) Applicant: Hewlett-Packard Development Company, L.P., Spring, TX (US)

(72) Inventor: Takayuki Horie, Yokohama (JP)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/255,687

(22) PCT Filed: Jul. 1, 2019

(86) PCT No.: PCT/US2019/040110
§ 371 (c)(1),
(2) Date: Dec. 23, 2020

(87) PCT Pub. No.: WO2020/027968
PCT Pub. Date: Feb. 6, 2020

(65) Prior Publication Data

US 2021/0286295 A1 Sep. 16, 2021

(30) Foreign Application Priority Data

Jul. 31, 2018 (JP) ..... JP2018-143840

(51) Int. Cl.
*G03G 15/20* (2006.01)

(52) U.S. Cl.
CPC ..... *G03G 15/2021* (2013.01); *G03G 15/2028* (2013.01)

(58) Field of Classification Search
CPC ..... G03G 15/2021
See application file for complete search history.

(56) References Cited

U.S. PATENT DOCUMENTS

| | | | |
|---|---|---|---|
| 2012/0001385 | A1 | 1/2012 | Hayashi |
| 2012/0328345 | A1 | 12/2012 | Kunii et al. |
| 2014/0072353 | A1 | 3/2014 | Kim et al. |
| 2016/0375680 | A1 | 12/2016 | Nishitani et al. |

FOREIGN PATENT DOCUMENTS

| | | | | |
|---|---|---|---|---|
| JP | H6-83219 | A | | 3/1994 |
| JP | 10-133506 | A | | 5/1998 |
| JP | 2000-75702 | A | | 3/2000 |
| JP | 2004-258537 | A | | 9/2004 |
| JP | 2004258537 | A | * | 9/2004 |
| JP | 2005-17619 | A | | 1/2005 |
| JP | 2005017619 | A | * | 1/2005 |
| JP | 2008-201590 | A | | 9/2008 |
| KR | 10-2006-0002503 | A | | 1/2006 |
| KR | 10-2011-0075350 | A | | 7/2011 |

* cited by examiner

*Primary Examiner* — Victor Verbitsky
(74) *Attorney, Agent, or Firm* — Jefferson IP Law, LLP

(57) ABSTRACT

An imaging system includes: a conveyor belt that conveys a medium having a toner image fixed thereto, along a conveying route; a heating element to heat the conveyor belt; and a pressing roller to press the conveyor belt against the heating element. The heating element may have a planar surface adjacent to an inner peripheral surface of the conveyor belt.

17 Claims, 10 Drawing Sheets

IMAGING SYSTEM INCLUDING HEATING ELEMENT AND COOLING DEVICE

BACKGROUND

An imaging apparatus may include a fixing device that fixes a toner image onto a medium. Downstream from the fixing device, the imaging apparatus may perform gloss processing on the toner image by which the toner fixed to the medium is processed to smoothen the toner surface.

DETAILED DESCRIPTION

In the following description, with reference to the drawings, the same reference numbers are assigned to the same components or to similar components having the same function, and overlapping description is omitted. In some examples, an imaging system may include an imaging apparatus such as a printer, a gloss processing device used in the imaging apparatus. In some examples, an imaging system may include a gloss processing device provided within or separately from the imaging apparatus.

Figure 1:
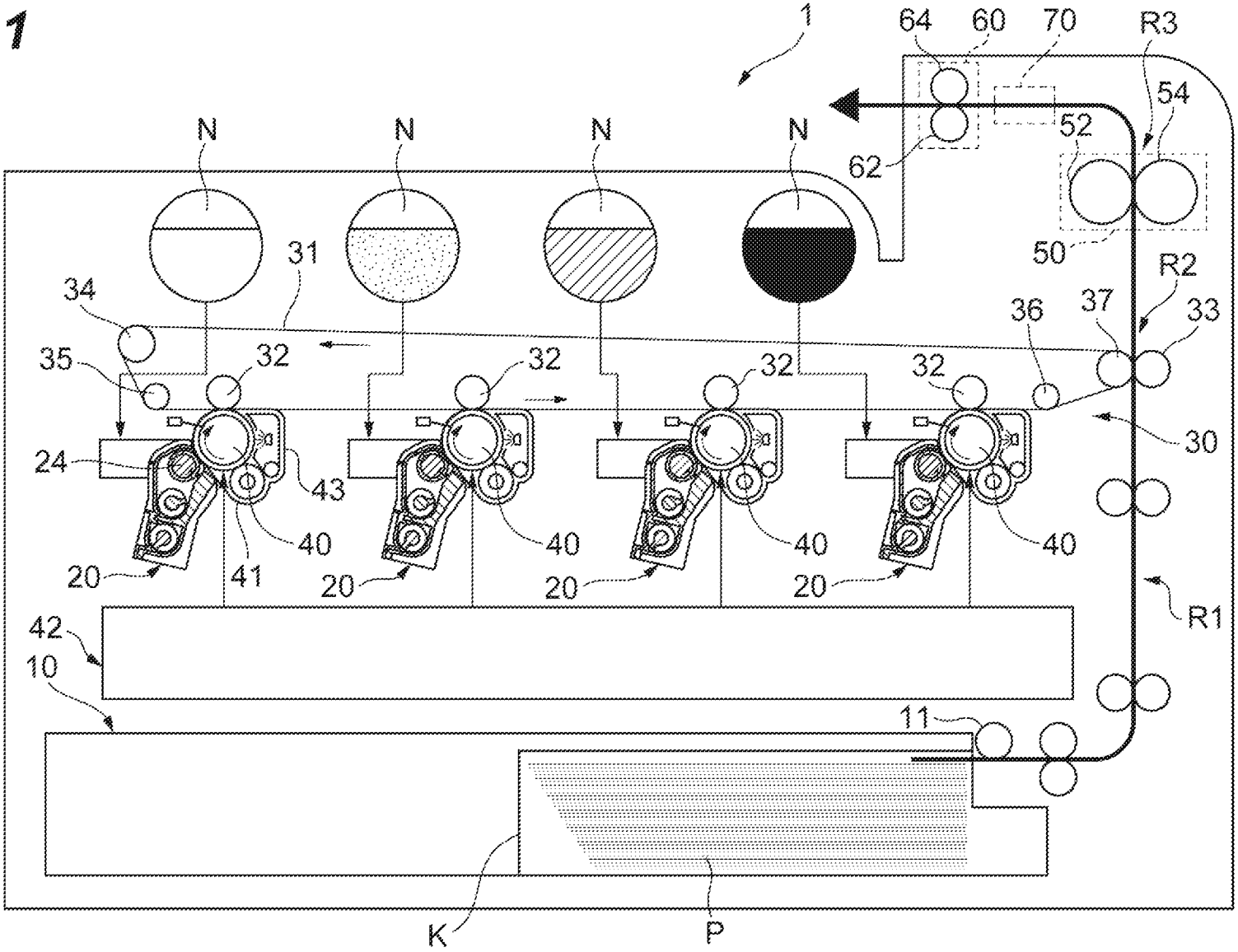
FIG. 1 is a schematic diagram of an example imaging apparatus.

FIG. 1 is a diagram illustrating a schematic configuration of an example imaging apparatus 1. With reference to FIG. 1, the example imaging apparatus 1 may be, for example, an apparatus which forms a color image using magenta, yellow, cyan, and black colors. The imaging apparatus 1 may include a conveying device 10 which conveys a sheet P corresponding to a recording medium, a developing device 20 which develops an electrostatic latent image, a transfer device 30 which secondarily transfers a toner image to the sheet P, an image carrier 40 in which an electrostatic latent image is formed on a surface (a peripheral surface), a fixing device 50 which fixes a toner image onto the sheet P, and a discharge device 60 which discharges the sheet P.

The conveying device 10 may convey the sheet P as a recording medium having an image formed thereon on a conveying route R1. The sheet P is stacked and accommodated on, for example, a cassette K and is picked up and conveyed by the feeding roller 11. The conveying device 10 allows the sheet P to reach a transfer nip portion R2 through the conveying route R1, for example, at a timing in which the toner image transferred onto the sheet P reaches the transfer nip portion R2.

Four developing devices 20 may be provided for the respective colors. Each developing device 20 may include a developing agent carrier 24 which carries toner on an image carrier 40. In the developing device 20, a two-component developing agent including toner and carrier may be used as a developing agent. That is, in the developing device 20, the toner and carrier are mixed so as to have a predetermined mixing ratio of the toner and carrier and the toner is uniformly dispersed. Accordingly, an optimal charge amount of the developing agent is adjusted. The developing agent is carried on the developing agent carrier 24. The developing agent carrier 24 rotates so that the developing agent is conveyed to a region facing the image carrier 40. Then, the toner in the developing agent carried on the developing agent carrier 24 moves (or transfers) to the image carrier 40, forming an electrostatic latent image on the peripheral surface of the image carrier 40 so that the electrostatic latent image is developed.

The transfer device 30 may convey the toner image formed by the developing device 20 to the transfer nip portion R2 in which the toner image is secondarily transferred onto the sheet P. The transfer device 30 may include a transfer belt 31 onto which the toner image is primarily transferred from the image carrier 40, suspension rollers 34, 35, 36, and 37 which suspend the transfer belt 31, a primary transfer roller 32 which sandwiches the transfer belt 31 along with the image carrier 40, and a secondary transfer roller 33 which sandwiches the transfer belt 31 along with the suspension roller 37.

The transfer belt 31 may include an endless belt which moves in a circulating manner by the suspension rollers 34, 35, 36, and 37. Each of the suspension rollers 34, 35, 36, and 37 is a roller which is rotatable about an axis. The suspension roller 37 may be, for example, a drive roller which is rotationally driven about its axis. The suspension rollers 34, 35, and 36 are, for example, driven rollers which rotate in a following manner in accordance with the rotational driving of the suspension roller 37. The primary transfer roller 32 may press the image carrier 40 from the inner peripheral side of the transfer belt 31. The secondary transfer roller 33 may be disposed in parallel to the suspension roller 37 with the transfer belt 31 interposed therebetween and may press the suspension roller 37 from the outer peripheral side of the transfer belt 31. Accordingly, the secondary transfer roller 33 may form the transfer nip portion R2 with respect to the transfer belt 31.

The image carrier 40 may also be referred to as an electrostatic latent image carrier, a photosensitive drum, or the like. Four image carriers 40 may be provided for the respective colors. Each image carrier 40 may be provided along the movement direction of the transfer belt 31. A developing device 20, a charging roller 41, an exposure unit 42, and a cleaning device 43 may be provided on the periphery of (or adjacent to) each image carrier 40.

The charging roller 41 may include a charging member that uniformly charges the surface of the image carrier 40 to a predetermined potential. The charging roller 41 may move to follow the rotation of the image carrier 40. The exposure unit 42 may expose the surface of the image carrier 40 charged by the charging roller 41 in response to the image formed on the sheet P. Accordingly, a potential of a portion exposed by the exposure unit 42 on the surface of the image carrier 40 changes to form the electrostatic latent image. For example, four developing devices 20 may generate a toner image by developing the electrostatic latent image formed on the image carrier 40 by toner supplied from a toner tank N located to face each developing device 20. For example, magenta, yellow, cyan, and black toners are respectively charged inside the toner tanks N. The cleaning device 43 may collect toner remaining on the image carrier 40 after the toner image formed on the image carrier 40 is primarily transferred onto the transfer belt 31.

In some examples, the fixing device 50 allows the sheet P to pass through a fixing nip portion R3 while heating and pressing the sheet so that the toner image secondarily transferred from the transfer belt 31 onto the sheet P adheres to the sheet P and the toner image is fixed thereto. The fixing device 50 may include a heating roller 52 which heats the sheet P and a pressing roller 54 which rotationally drives the heating roller 52 in a pressed state. The heating roller 52 and the pressing roller 54 are formed in, for example, a cylindrical shape and the heating roller 52 includes a heat source such as a halogen lamp provided therein. The fixing nip portion R3 corresponding to a contact region is provided between the heating roller 52 and the pressing roller 54 and the sheet P is made to pass through the fixing nip portion R3 so that the toner image is melted and fixed onto the sheet P.

The discharge device 60 may include discharge rollers 62 and 64 which discharge the sheet P onto which the toner image is fixed by the fixing device 50 to the outside of the apparatus.

An example printing process carried out by the example imaging apparatus 1 will be described. When an image signal of a recording target image is input to the imaging apparatus 1, a control unit of the imaging apparatus 1 rotates the feeding roller 11 so that the sheet P stacked on the cassette K is picked up and conveyed. Then, the surface of the image carrier 40 is uniformly charged to a predetermined potential by the charging roller 41 (a charging process). Subsequently, an electrostatic latent image is formed in such a manner that the exposure unit 42 irradiates a laser beam to the surface of the image carrier 40 based on the received image signal (an exposing process).

In the developing device 20, the electrostatic latent image is developed to form a toner image (a developing process). The toner image which is formed in this way is primarily transferred from the image carrier 40 to the transfer belt 31 in a region in which the image carrier 40 faces the transfer belt 31 (a transfer process). The toner images formed on four image carriers 40 are laminated on the transfer belt 31 to form one laminated toner image. Then, the laminated toner image is secondarily transferred onto the sheet P conveyed from the conveying device 10 in the transfer nip portion R2 in which the suspension roller 37 faces the secondary transfer roller 33.

The sheet P onto which the laminated toner image is secondarily transferred, is conveyed to the fixing device 50. Then, the fixing device 50 melts and fixes the laminated toner image onto the sheet P by heating and pressing the sheet P between the heating roller 52 and the pressing roller 54 when the sheet P passes through the fixing nip portion R3 (a fixing process). The sheet P is discharged to the outside of the imaging apparatus 1 by the discharge rollers 62 and 64.

Figure 2:
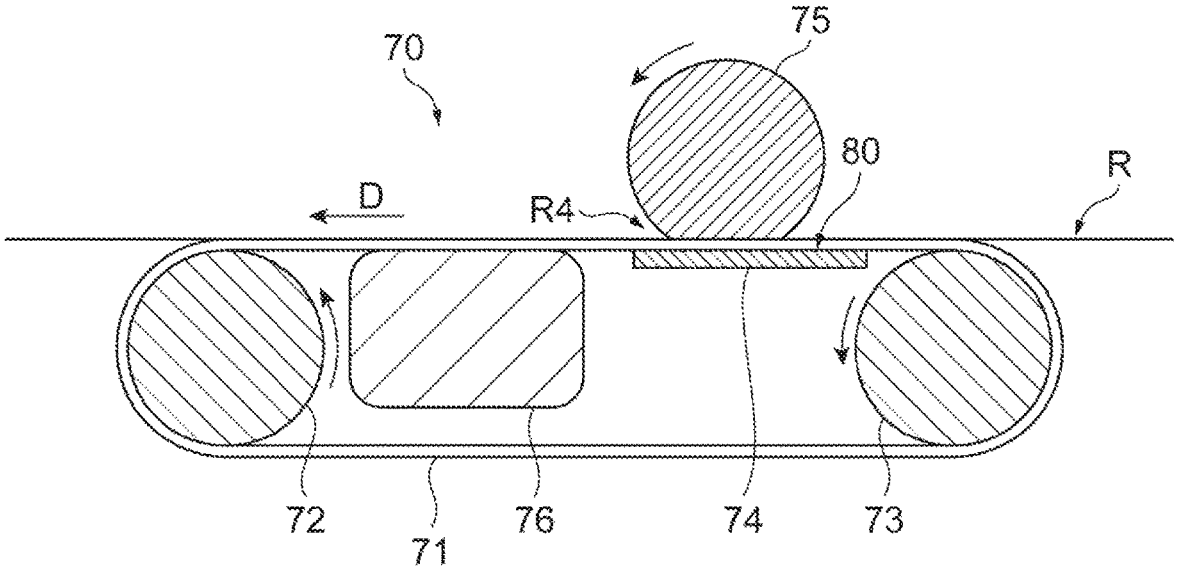
FIG. 2 is a schematic cross-sectional view of an example gloss processing device in an example imaging apparatus.
Figure 3:
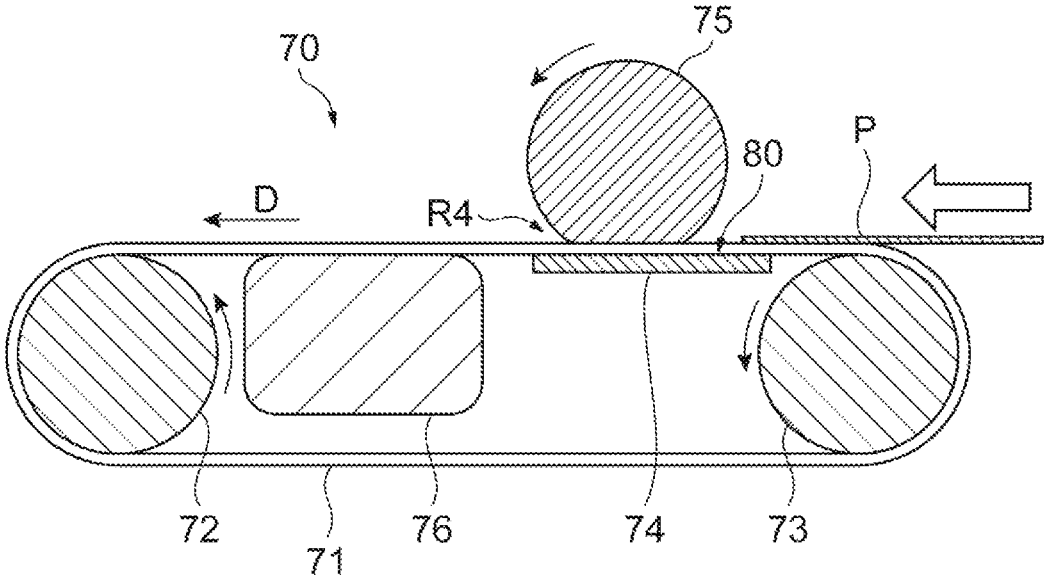
FIG. 3 is another schematic cross-sectional view of the example gloss processing device.

The example imaging apparatus 1 further includes a gloss processing device 70. With reference to FIGS. 2 and 3, the gloss processing device 70 performs gloss processing on the sheet P onto which the toner image is fixed by the fixing device 50. The gloss processing device 70 may be disposed between the fixing device 50 and the discharge device 60 in the conveying route of the sheet P, but may be attached to the discharge device 60 or may be provided separately from the imaging apparatus 1. The imaging apparatus 1 may have a glossy print mode and a normal print mode. The glossy print mode is a mode in which the sheet P onto which the toner image is fixed by the fixing device 50 is supplied to the gloss processing device 70. The normal print mode is a mode in which the sheet P onto which the toner image is fixed by the fixing device 50 is not supplied to the gloss processing device 70 and is discharged to the outside. The glossy print mode and the normal print mode can be switched by a user setting, for example.

The gloss processing device 70 includes, for example, a conveyor belt 71, a first roller 72, a second roller 73, a planar heating element 74, a pressing roller 75, and a cooling device 76.

The conveyor belt 71 is an endless belt which conveys the sheet P along the conveying route R. The conveying route R is a route along which the sheet P is conveyed and passes, on the outer peripheral surface of the conveyor belt 71. The outer peripheral surface of the conveyor belt 71 has a smooth surface for smoothening the toner image of the sheet P.

The first roller 72 and the second roller 73 are belt rollers which engage with the conveyor belt 71. In some examples, one or more other rollers may engage with the conveyor belt 71. The second roller 73 is disposed on the upstream side of the first roller 72 in the conveying direction D of the sheet P being conveyed along the conveying route R. Each of the first roller 72 and the second roller 73 is a roller which is rotatable about an axis. The first roller 72 and the second roller 73 are disposed on the inner peripheral side of the conveyor belt 71 to suspend or support the conveyor belt 71. Each of the first roller 72 and the second roller 73 may be a drive roller or a driven roller. The conveying route R may pass along the outer peripheral surface of the conveyor belt 71 between the first roller 72 and the second roller 73.

The planar heating element 74 is a heating element which heats the toner image fixed to the sheet P to melt the toner image again. The planar heating element 74 may be a heat plate which receives power to generate heat. The planar heating element 74 is located between the first roller 72 and the second roller 73 along the conveying route R and is located adjacent to the conveyor belt 71. The planar heating element 74 may be fixed to (or supported by) a frame of the imaging apparatus 1.

The pressing roller 75 is a roller which applies a pressure to the sheet P conveyed by the conveyor belt 71. The pressing roller 75 is located adjacent to the conveyor belt 71 in order to apply a pressure to the sheet P. For example, the pressing roller 75 may be disposed on the opposite side to the planar heating element 74 in the conveyor belt 71 to be pressed against the planar heating element 74 through the conveyor belt 71 by a pressing mechanism (not shown) (e.g. the pressing roller 75 may press the conveyor belt 71 against the planar heating element 74). The pressing mechanism may include an urging mechanism which urges the pressing roller 75 toward the planar heating element 74 or a support mechanism which supports the pressing roller 75 so as to maintain a state in which the pressing roller 75 is pressed against the planar heating element 74. The pressing roller 75 may be a drive roller or a driven roller.

The cooling device 76 cools and solidifies the toner image having been melted by the planar heating element 74 so that the toner surface becomes smooth and suppresses adherence of the toner image to the conveyor belt 71. The cooling device 76 may include a heat sink, a cooling fan, a heat pipe, or a peltier device. The cooling device 76 may be located on the downstream side of the planar heating element 74 between the first roller 72 and the second roller 73 along the conveying route R. The cooling device 76 may be located on the inner peripheral side of the conveyor belt 71, adjacent to the conveyor belt 71.

The planar heating element 74 includes a heated surface 80 which heats the conveyor belt 71. The heated surface 80 is a surface for heating and melting the toner image fixed to the sheet P. The heated surface 80 forms a planar surface along the conveyor belt 71. The heated surface 80 is located between the first roller 72 and the second roller 73 in the conveying route R and is disposed adjacent to the conveyor belt 71 from the inner peripheral side of the conveyor belt 71. The heated surface 80 and the conveyor belt 71 may contact each other. In order to reduce a friction resistance, a lubricant such as oil wax or a sliding sheet having a low friction surface may be interposed between the heated surface 80 and the conveyor belt 71. When the conveyor belt 71 rotates and the heated surface 80 and the conveyor belt 71 are in contact with each other, the conveyor belt 71 slides on the heated surface 80 while contacting the heated surface 80. When the conveyor belt 71 rotates and a lubricant or a sliding sheet is interposed between the heated surface 80 and the conveyor belt 71, the conveyor belt 71 slides on the heated surface 80 while contacting the lubricant or sliding sheet.

Figure 4:
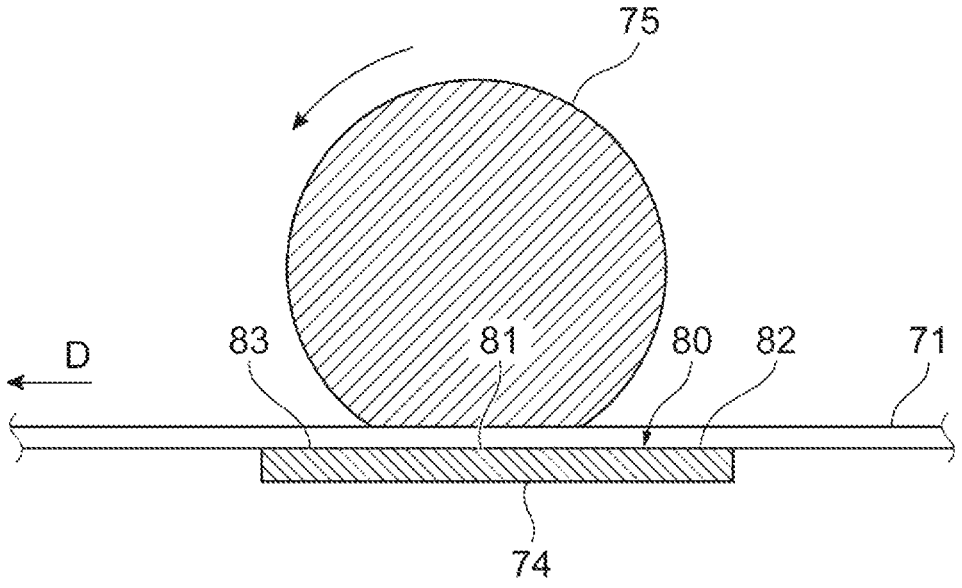
FIG. 4 is a diagram illustrating components of the example gloss processing device, including a pressing roller and a planar heating element.

The heated surface 80 may be longer than a pressing region formed between the heated surface 80 and the pressing roller 75 in the conveying direction D. As illustrated in FIGS. 2 to 4, the heated surface 80 may include a first heated surface (or first heated surface portion) 81 which is pressed by the pressing roller 75, a second heated surface (or second heated surface portion) 82 which is disposed on the upstream side of the first heated surface 81 in the conveying direction D, and a third heated surface (or third heated surface portion) 83 which is disposed on the downstream side of the first heated surface 81 in the conveying direction D.

The first heated surface 81 is a heated surface which is located between the first roller 72 and the second roller 73, and contacts a portion adjacent to the pressing roller 75 in the conveyor belt 71. The first heated surface 81 heats the toner image of the sheet P through the conveyor belt 71. The first heated surface 81 is formed in the pressing region between the heated surface 80 and the pressing roller 75 and forms a nip portion R4 with respect to the conveyor belt 71 to heat and press the sheet P.

The second heated surface 82 is a heated surface which is located between the first heated surface 81 and the second roller 73, and contacts a portion of the conveyor belt 71 that is not adjacent to the pressing roller 75 (e.g. contacts a portion of the conveyor belt 71 that is offset from the pressing roller 75 along the conveying route R). The second heated surface 82 extends from the first heated surface 81 to the upstream side relative to the conveying direction D, and heats the toner image of the sheet P through the conveyor belt 71 to be supplied to the pressing roller 75. The second heated surface 82 forms a heating route for heating the sheet P to be supplied to the pressing roller 75.

The third heated surface 83 is located between the first heated surface 81 and the first roller 72, and contacts a portion of the conveyor belt 71 that is not adjacent to the pressing roller 75 (e.g. contacts a portion of the conveyor belt 71 that is offset from the pressing roller 75 along the conveying route R). The third heated surface 83 extends from the first heated surface 81 to the downstream side of the conveying direction D, and heats the toner image of the sheet P after the sheet is discharged from the pressing roller 75. The third heated surface 83 forms a heating route for heating the sheet P discharged from the pressing roller 75 and is formed in the heating route.

Figure 10:
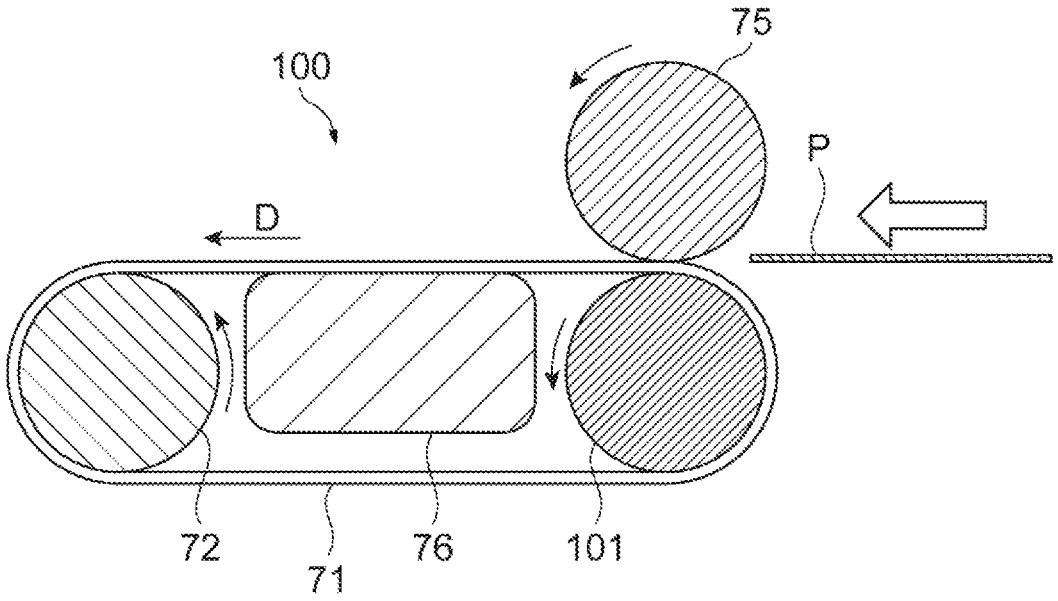
FIG. 10 is a schematic cross-sectional view of a gloss processing device of a reference example.

Referring to FIG. 10, a gloss processing device 100 of reference example will be described. As illustrated in FIG. 10, the gloss processing device 100 of reference example has a configuration in which the conveyor belt 71 is suspended (or supported) on a first roller 72 and a heating roller 101 and a pressing roller 75 is pressed against a heating roller 101 with the conveyor belt 71 interposed therebetween. In the gloss processing device 100, the sheet P is supplied to the conveyor belt 71 so that the fixed toner image is disposed on a side facing the conveyor belt 71. Then, when the sheet P is conveyed by the conveyor belt 71, the toner image of the sheet P is pressed and heated by the heating roller 101 and the pressing roller 75 to be melted again and then is cooled and solidified by the cooling device 76 while being in close contact with the conveyor belt 71. Accordingly, the smooth surface of the conveyor belt 71 is transferred to the toner image so that the toner surface becomes smooth.

Figure 5:
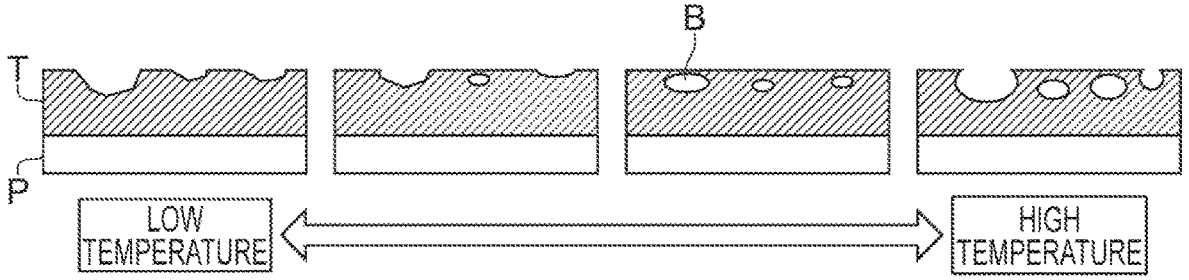
FIG. 5 shows schematic diagrams illustrating examples of toner image states.
Figure 6:
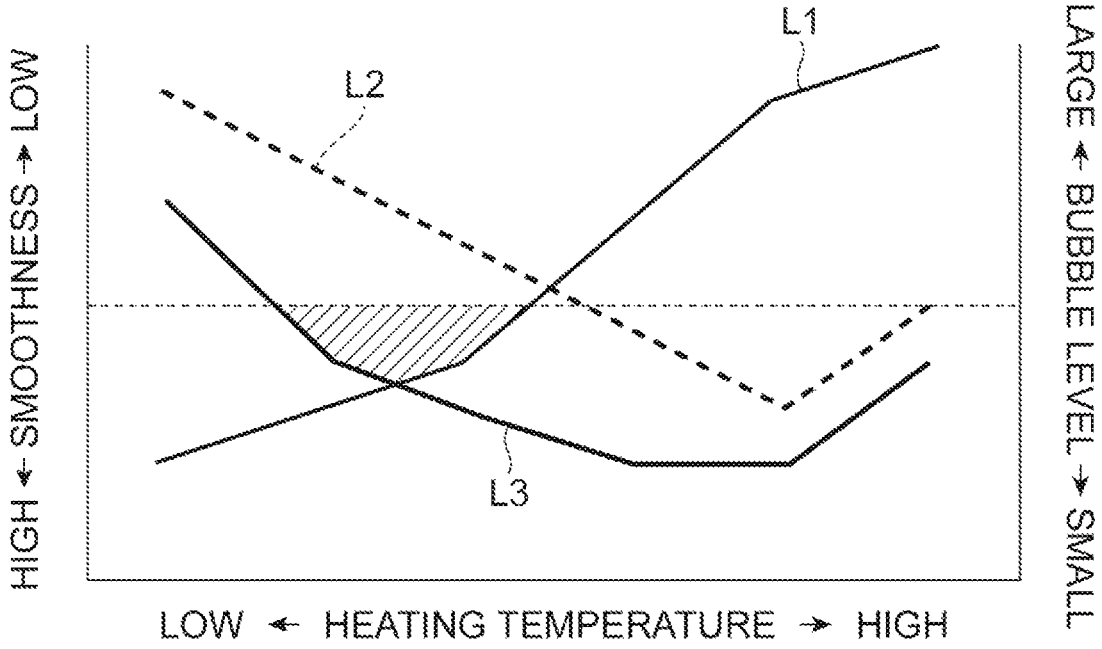
FIG. 6 is a graph showing relationships of smoothness of a toner image, and of a bubble level of the toner image, relative to heating temperatures.

Referring to FIGS. 5 and 6, a heated and melted toner image state will be described. In FIG. 6, a line L1 indicates a level of a bubble generation amount (a bubble level), a line L2 indicates smoothness under a condition α, and a line L3 indicates smoothness under a condition β. In the conditions α and β, the sheet conveying speed is set to be the same. However, the heating length of the sheet P in the conveying direction D is set to 2 mm in the condition α and the heating length of the sheet P in the conveying direction D is set to 8 mm in the condition β. As illustrated in FIGS. 5 and 6, when the fixed toner image T is heated and melted, the surface of the toner image T becomes smooth. However, as the heating temperature rises, bubbles B appear in the toner image T. Since the bubble generation amount increases as the heating temperature becomes higher, the image may become whitish and muddy, which may deteriorate the image quality. Further, when the heating temperature rises further, the bubble B may expand and rupture and the toner surface of the toner image also becomes rough. For example, the bubble B may expand and rupture at the toner surface, and consequently make the toner surface uneven or rough. Further, as apparent from a difference between the line L2 and the line L3 in FIG. 6, the smoothness at lower heating temperatures increases when the heating time is set to be longer. For example, as indicated by a hatched area of FIG. 6, when the heating time is set to be longer at the heating temperature in which the level of the bubble generation amount does not exceed a predetermined value, it is possible to suppress the generation of the bubble and to improve the smoothness of the toner image T.

However, in the gloss processing device 100 of the reference example, the toner image of the sheet P is heated exclusively in the pressing region (the nip portion R4) between the heating roller 101 and the pressing roller 75. If the conveying speed of the sheet P is decreased in order to extend the heating time at a temperature at which bubble generation is suppressed, then the number of sheets to be printed per hour decreases.

In the example gloss processing device 70 (with reference to FIGS. 2 to 4), the heated surface 80 of the planar heating element 74 is longer than the pressing region (the nip portion R4) between the heated surface 80 and the pressing roller 75 in the conveying direction D and the toner image of the sheet P conveyed by the conveyor belt 71 is sequentially heated by the second heated surface 82, the first heated surface 81 (which may substantially correspond to the nip portion R4 or the pressing region), and the third heated surface 83. Accordingly, since a distance for heating the toner image to be melted again can be set to be longer as compared to the gloss processing device 100 of the reference example, the heating time can be set to be longer as compared to the reference example even without changing the conveying speed of the sheet P. Accordingly, the heating temperature for melting the toner image again can be set to a heating temperature by which the generation of bubble is suppressed and the smoothness of the toner image can be improved.

Figure 7:
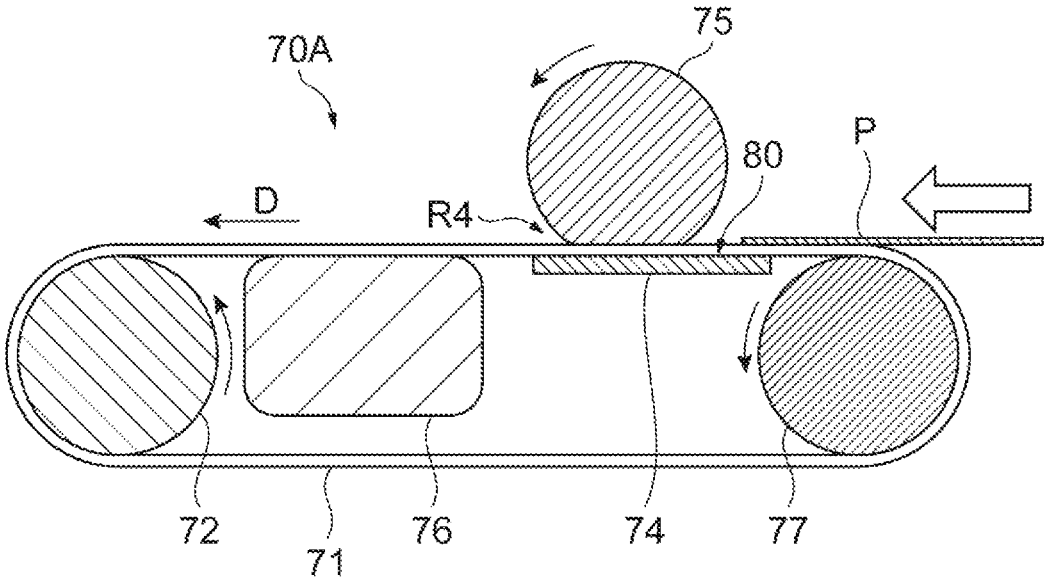
FIG. 7 is a schematic cross-sectional view of an example gloss processing device.

With reference to FIG. 7, another example gloss processing device 70A may include a conveyor belt 71, a first roller 72, a heating roller 77, a planar heating element 74, a pressing roller 75, and a cooling device 76.

The heating roller 77 is a belt roller which engages with the conveyor belt 71 along with the first roller 72. The heating roller 77 is disposed at the same position as that of the second roller 73 of the gloss processing device 70 (FIG. 2). The heating roller 77 may be a roller which is supported to be rotatable about an axis, as a drive roller or a driven roller.

The heating roller 77 includes a heating element for heating and melting the toner image fixed to the sheet P. The heating element may be the heating roller 77 itself or may be disposed inside the heating roller 77. In some examples, the heating roller 77 may be formed as a heater that generates heat by receiving power, where the heating roller 77 itself becomes the heating element. In other example, a heating element, such as a halogen lamp, an induction heating device, and/or the like, may be disposed inside the heating roller 77. Accordingly, the heating roller 77 heats the sheet P conveyed by the conveyor belt 71 in such a manner that the heating roller heats the engaging conveyor belt 71.

The heating roller 77 is located on an upstream side of the pressing roller 75 in the conveying direction D and the heating roller 77 heats the conveyor belt 71. Consequently, the sheet P conveyed by the conveyor belt 71 is heated by the heating roller 77 before the sheet is supplied to the pressing roller 75, thereby further extending the heating time. Accordingly, it is possible to melt the toner image again at a lower temperature as compared with the reference example.

Figure 8:
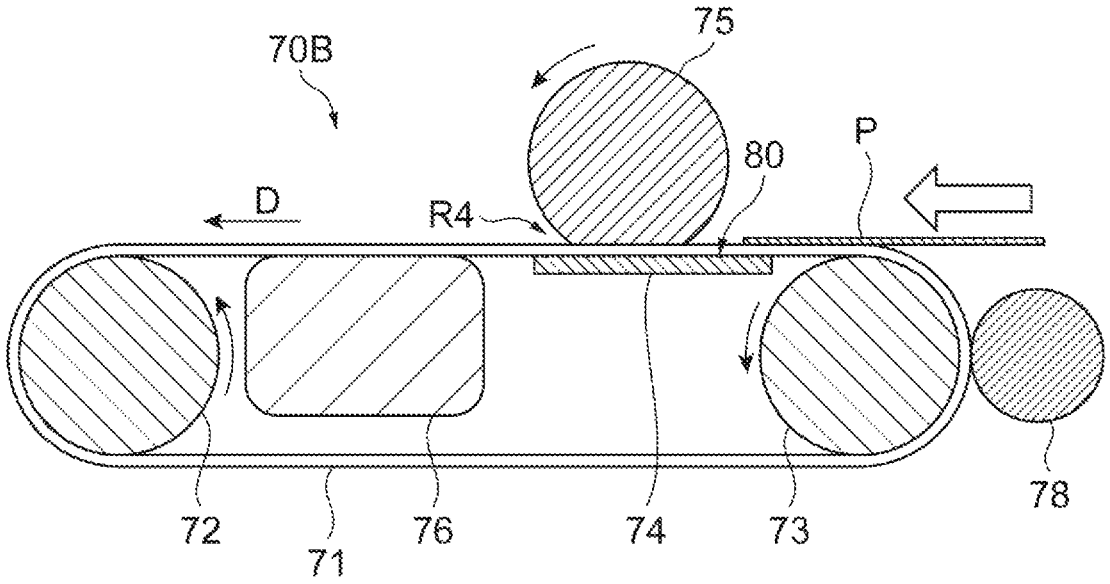
FIG. 8 is a schematic cross-sectional view of an example gloss processing device.

With reference to FIG. 8, another example gloss processing device 70B may include a conveyor belt 71, a first roller 72, a second roller 73, a planar heating element 74, a pressing roller 75, a cooling device 76, and a heating roller 78.

The heating roller 78 is an external roller located adjacent an outer peripheral side of the conveyor belt 71 to contact a portion of the conveyor belt 71 that engages with the second roller 73 in the conveyor belt 71. The heating roller 78 is located at a position that sandwiches the conveyor belt 71 along with the second roller 73. The heating roller 78 may be a roller which is supported to be rotatable about an axis, as a drive roller, or a driven roller.

The heating roller 78 includes a heating element for heating and melting the toner image fixed to the sheet P. The heating element may be the heating roller 78 itself or may be disposed inside the heating roller 78. In some examples, the heating roller 78 may be formed as a heater that receives power to generate heat, so that the heating roller 78 itself functions as a heating element. In some examples, a heating element such as halogen lamp, an electromagnetic coil and/or the like, may be located inside the heating roller 78. Accordingly, the heating roller 78 heats the sheet P conveyed by the conveyor belt 71 in such a manner that the heating roller heats the contacting conveyor belt 71.

The heating roller 78 is located adjacent a portion of the of the conveyor belt 71 that engages with the second roller 73, to heat the conveyor belt 71. Consequently, the sheet P conveyed by the conveyor belt 71 is heated by the heating roller 78 before the sheet is supplied to the pressing roller 75, and it is possible to further extend the heating time as compared with the reference example. Accordingly, it is possible to melt the toner image again at a lower temperature.

Figure 9:
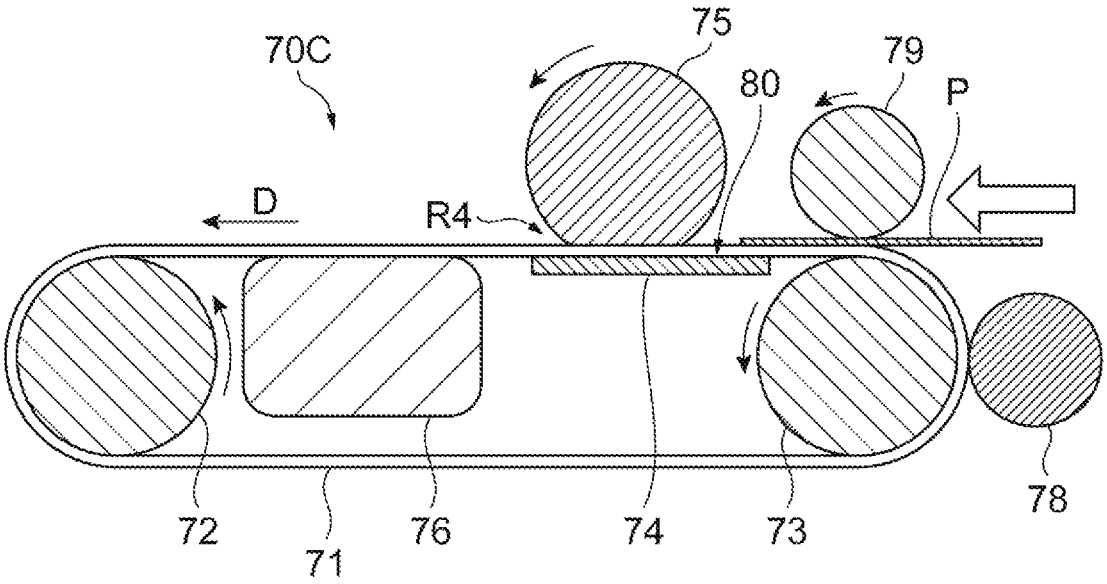
FIG. 9 is a schematic cross-sectional view of an example gloss processing device.

With reference to FIG. 9, another example gloss processing device 70C may include a conveyor belt 71, a first roller 72, a second roller 73, a planar heating element 74, a pressing roller 75, a cooling device 76, and an assisting roller 79.

The assisting roller 79 may be a roller which assists the contact of the sheet P with respect to the conveyor belt 71. The assisting roller 79 is disposed on the upstream side of the pressing roller 75 in the conveying direction D on the conveying route R to contact the conveyor belt 71 from a side of the conveyor belt 71 that is opposite to the heated surface 80. The assisting roller 79 may contact a portion of the conveyor belt 71 that engages the second roller 73 in the conveyor belt 71 on the conveying route R. The assisting roller 79 may be located between the pressing roller 75 and the second roller 73. The assisting roller 79 may be a roller which is supported to be rotatable about an axis, as a drive roller, or a driven roller.

When the sheet P is spaced away from the conveyor belt 71, the heating efficiency of the sheet P using the planar heating element 74 decreases. In the gloss processing device 70C, the assisting roller 79 contacts the conveyor belt 71 from the opposite side to the heated surface 80 on the upstream side of the pressing roller 75 in the conveying direction D. Consequently, when the sheet P is supplied between the assisting roller 79 and the conveyor belt 71, the assisting roller 79 improves the contact of the sheet P with respect to the conveyor belt 71. Accordingly, it is possible to improve the heating efficiency of the sheet P using the planar heating element 74.

It is to be understood that not all aspects, advantages and features described herein may necessarily be achieved by, or included in, any one particular example. Indeed, having described and illustrated various examples herein, it should be apparent that other examples may be modified in arrangement and detail. For example, in the above-described examples, the planar heating element is used as an example of the heating element, but the heating element is not limited to the planar heating element and may accommodate, for example, a heat source such as a halogen lamp and an induction heating device. Further, the conveyor belt 71 may be supported while engaging with the rollers having three shafts or more.

The invention claimed is:

1. An imaging system comprising:

an endless belt to convey a medium having a toner image fixed thereto, along a conveying route in a conveying direction;

a pair of rollers including a first roller and a second roller, to engage with the endless belt;

a heating element located between the first roller and the second roller along the conveying route, the heating element having a planar surface adjacent to an inner peripheral surface of the endless belt;

a pressing roller to apply a pressure to the medium conveyed by the endless belt, wherein the pressing roller is located on a side of the endless belt that is opposite to the planar surface of the heating element;

a cooling device located downstream from the heating element in the conveying direction of the conveying route of the medium, between the first roller and the second roller; and an external roller, including a heating element, located upstream from the heating element in the conveying direction of the conveying route of the medium and adjacent to an outer peripheral side of the endless belt to directly contact a portion of the endless belt that engages with the second roller.

2. The imaging system according to claim 1, wherein the planar surface of the heating element includes a first heated surface portion contacting a portion of the endless belt adjacent to the pressing roller and a second heated surface portion located between the first heated surface portion and the second roller and contacting a portion of the endless belt that is offset relative to the pressing roller, along the conveying route.

3. The imaging system according to claim 2, wherein the second roller is located upstream from the first roller in the conveying direction.

4. The imaging system according to claim 3, wherein the second roller includes a heating element.

5. The imaging system according to claim 1, further comprising:

an assisting roller located upstream from the pressing roller in the conveying route, the assisting roller to contact a surface of the endless belt that is opposite to the inner peripheral surface of the endless belt.

6. The imaging system according to claim 1, wherein the external roller is located at a position that sandwiches the endless belt with the second roller.

7. The imaging system according to claim 1, wherein the external roller is located at a position upstream of the pressing roller to heat the endless belt before the pressure is applied to the medium conveyed by the endless belt.

8. An imaging system comprising:

an endless belt to convey a medium having a toner image fixed thereto, along a conveying route;

a pressing roller located adjacent the endless belt to apply a pressure to the medium;

a heating element located adjacent to an inner peripheral surface of the endless belt, the heating element including a first heated surface portion to contact a portion of the endless belt adjacent to the pressing roller and a second heated surface portion located upstream from the first heated surface portion to heat the medium to be supplied to the pressing roller;

a cooling device located downstream from the heating element in a conveying direction of the medium, to cool the endless belt;

a heating roller located upstream from the pressing roller in the conveying route, the heating roller to directly contact a surface of the endless belt that is opposite to the inner peripheral surface of the endless belt; and an assisting roller located upstream from the pressing roller in the conveying route, the assisting roller to directly contact the surface of the endless belt that is opposite to the inner peripheral surface of the endless belt.

9. The imaging system according to claim 8, further comprising:

a pair of rollers including a first roller and a second roller to engage with the endless belt, wherein the first heated surface portion and the second heated surface portion of the heating element are located between the first roller and the second roller along the conveying route.

10. The imaging system according to claim 8, further comprising a belt roller to engage with the endless belt, wherein the belt roller includes a heating element.

11. The imaging system according to claim 8, wherein the assisting roller is to apply a pressure to the medium.

12. The imaging system according to claim 9, wherein the assisting roller is to contact the surface of the endless belt at a location that engages the second roller.

13. An imaging system comprising:

a conveyor belt to convey a medium having a toner image fixed thereto, along a conveying route in a conveying direction;

a heating element having a heated surface to heat the conveyor belt;

a pressing roller located on a side of the conveyor belt that is opposite to the heated surface of the heating element, the pressing roller to press the conveyor belt against the heated surface in a pressing region;

a heating roller located upstream from the pressing roller in the conveying route and adjacent to the side of the conveyor belt that is opposite to the heated surface of the heating element; and an assisting roller located upstream from the pressing roller in the conveying route, the assisting roller to directly contact the side of the conveyor belt that is opposite to the heated surface of the heating element, wherein the heated surface of the heating element is longer in the conveying direction than the pressing region between the heated surface and the pressing roller.

14. The imaging system according to claim 13, wherein the heated surface includes a first heated surface portion located in alignment with the pressing roller and a second heated surface portion located upstream from the first heated surface portion in the conveying direction.

15. The imaging system according to claim 13, further comprising:

a first roller and a second roller to engage with the conveyor belt, wherein the second roller is a heating roller located upstream from the first roller in the conveying route.

16. The imaging system according to claim 13, further comprising:

a first roller and a second roller to engage with the conveyor belt, the second roller being located upstream from the first roller in the conveying route, wherein the heating roller is to contact a portion of the conveyor belt adjacent the second roller.

17. The imaging system according to claim 16, wherein the heating roller is located at a position that sandwiches the conveyor belt with the second roller.

* * * * *